United States Patent [19]

Doiron

[11] Patent Number: 4,608,901

[45] Date of Patent: Sep. 2, 1986

[54] SAFETY CHAIN FOR CHAIN SAWS

[75] Inventor: Gerald J. Doiron, Hyannis, Mass.

[73] Assignee: Omark Industries, Inc., Portland, Oreg.

[21] Appl. No.: 563,211

[22] Filed: Dec. 19, 1983

[51] Int. Cl.[4] ..... B27B 33/14

[52] U.S. Cl. ..... 83/834; 30/382; 83/830; 83/DIG. 1

[58] Field of Search ..... 83/830, 834, 833, 814, 83/544, DIG. 1; 30/381, 382

[56] References Cited

U.S. PATENT DOCUMENTS

| | | | |
|---|---|---|---|
| 3,183,947 | 5/1965 | Johnson et al. | 83/478 X |
| 3,224,476 | 12/1965 | Chadwick | 83/834 |
| 3,329,183 | 7/1967 | Robinson | 83/834 |
| 3,977,288 | 8/1976 | Goldblatt et al. | 83/834 X |
| 4,074,604 | 2/1978 | Goldblatt et al. | 83/834 X |
| 4,269,100 | 5/1981 | Deelman et al. | 83/834 |
| 4,425,830 | 1/1984 | Atkinson | 83/834 X |
| 4,430,795 | 2/1984 | Wetzel et al. | 30/382 |

*Primary Examiner*—Frank T. Yost

*Attorney, Agent, or Firm*—John W. Stuart

[57] ABSTRACT

A cutting chain for a chain saw including a safety element normally preventing the cutter tooth from cutting wherein the safety element is mounted on the driver link and by inward pressure; i.e., toward the cutter bar, is rotated to a position under the cutter tooth so that the latter may cut.

7 Claims, 3 Drawing Figures

FIG. 1
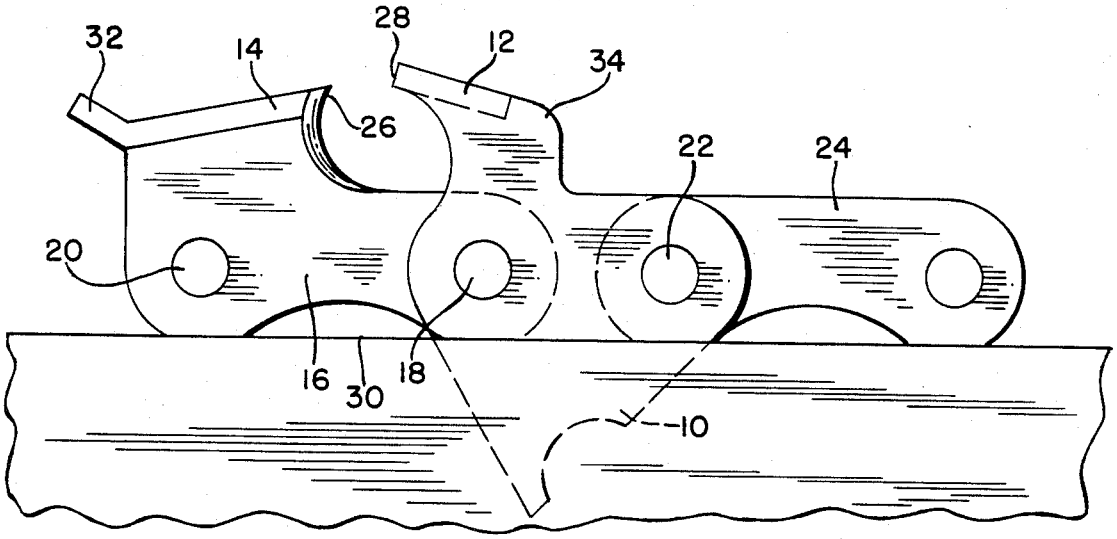
FIG. 2
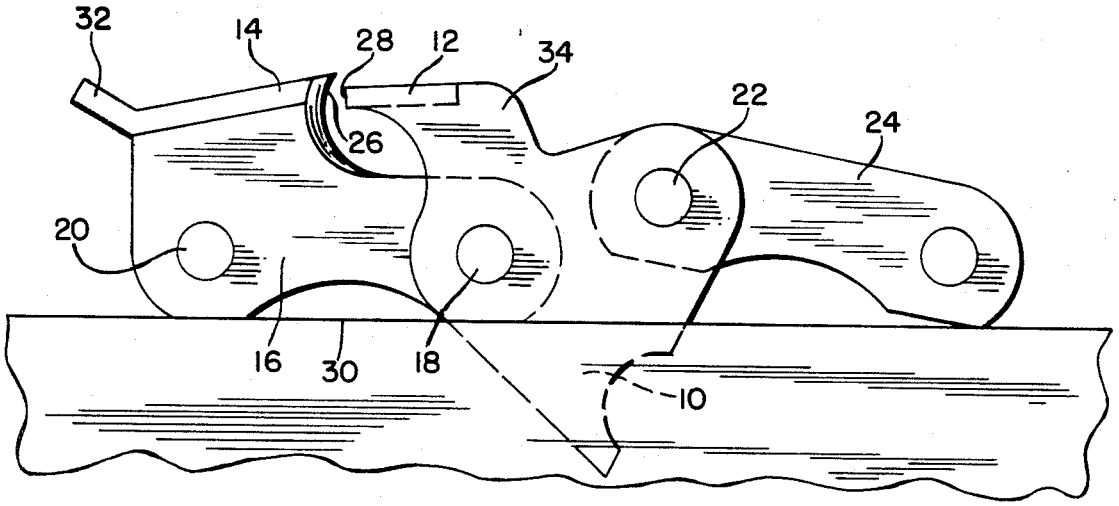
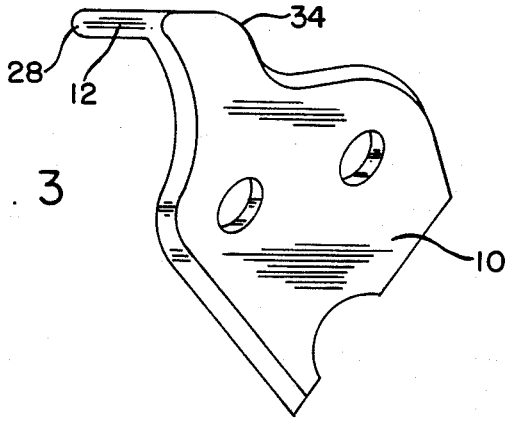
FIG. 3

SAFETY CHAIN FOR CHAIN SAWS

BACKGROUND OF THE INVENTION

Reference is hereby made to applicant's co-pending applications, Ser. No. 544,783 now abandoned, filed Oct. 24, 1983 and 552,825, filed Nov. 17, 1983, relating to safety chains for chain saws. These applications show, in general, chain saw constructions wherein the pivots used to articulate the chain are normally arranged in a straight line due to tension on the chain, with provision for the retraction of certain of the pivot pins and parts of the links from a normal safety position of the safety element guarding the cutting teeth, upon engagement therewith of a hard object, such as wood, and non-retraction under conditions of engagement with a softer body, such as a human being. This case is directed to the same general subject matter. The present invention differs from the above-identified inventions by providing a distinctly different placement of the safety member. In this case, the action is somewhat "heavier" in that it takes more pressure to cause the action to move from a safety position to a cutting positions, and thus is appropriate to a greater degree to heavier "professional" chain saws; whereas in the patent applications above-identified, the pressure required is less so that they are more adapted to smaller or "amateur" chain saws.

SUMMARY OF THE INVENTION

In this case, the cutter member is held fixed and the safety member is placed on a driving link. The pivot pin articulating the chain are all in line due to the tension of the chain on the cutter bar and the safety member is normally in safety position; i.e., extending outwardly away from the blade beyond the cutter edge. However, when the blade is applied to a hard body, such as wood, the safety member is depressed by a rotative action of the driving link upon which it is mounted, and the pivot axis for this is substantially in line perpendicular to the cutter bar, so that when the driving link is so rotated, its pivot pin with relation to the next link in the chain rises, relatively speaking, from the bottom of the kerf of the cutter box. This rotates the safety in a direction to be retracted beneath the cutter edge so that the cutter can operate. This action requires a great deal more pressure on the chain saw than those described above in said identified applications and, therefore, it will be seen that the present invention is more adapted to large, heavy, professional chain saw whereas the structure described in the applications identified above are more adapted to smaller chain saws which are used by amateurs.

BRIEF DESCRIPTION OF THE DRAWINGS

FIG. 1 is a view illustrating the condition of the chain as it is being driven under no load or light load conditions such as an engagement with a human body; i.e., safety situation; and FIG. 2 is a similar view but showing the arrangement of the links under conditions of application of the chain saw and chain to a harder body such as a piece of wood; i.e., operative cutting situation; and FIG. 3 is a perspective view of the driving link.

PREFERRED EMBODIMENT OF THE INVENTION

In FIG. 1, the driver link is shown at 10 and the safety element is shown at 12 as mounted on the driver link.

The cutter tooth is shown at 14 and it is mounted on the link 16 pivoted to driver link 10 by a pivot, or pivot member, 18 which is normally in a line with pivots, or pivot members 20 and 22 which, as will be clear to those skilled in the art, are pivoted with relation to connecting links 24.

It will be observed that the cutting tooth edge 26 in FIG. 1 is below the cutter extent of the safety member 28; whereas, in FIG. 2, the cutting tooth edge 26 is above or beyond the furthest extent 28 of the safety member 12. This is occasioned by rotation of driver link 10 in a counter-clockwise direction so that the pivot 22 relatively rises from the bottom 30 of the kerf of the saw blade about pivot 18 as an axis and it will be seen that this action requires a considerable amount of downward pressure on the safety member 12.

The cutting tooth 14 may be provided with a tab 32 which acts to lower the vibration of the chain and, if desired, a cutter gauge 34 may be applied to the safety member so that when in the FIG. 2 position the penetration of the cutter 26 will be limited. The pivoting action described requires the pivotal lifting of the link 24 as well as motion of the driver link 10 and this, of course, adds resistance to occasion the result required; i.e., to uncover the cutting tooth in order to cut.

It will be observed that in the present case the pivot 18 remains in position where it is in a fixed relationship with regard to the cutter bar as distinct from the construction in the above-identified cases wherein the safety member moves generally perpendicularly; in this case, it moves rotationally.

It will be seen that tab 32 and cutter gauge 34 together cooperate to limit the depth of cut of the tooth edge 26 because they are in the same plane, as in FIG. 2, below the tooth edge in cutting condition of the chain.

I claim:

1. A chain for a chain saw having the usual cutter bar, the chain comprising in-line articulated driving links, and cutting tooth links, safety members on the driving links, cutting teeth on the cutting tooth links, safety members having two positions with respect to the chain, including a first position in which the safety members guard the cutting teeth to inhibit cutting and a second position exposing the cutting teeth to permit cutting, a pivot for each driver link adjacent the safety member, said driver links extending longitudinally of the chain from the area of the safety members, said pivot providing and axis about which a driving element may be rotated slightly between its first and second positions, and added pivots joining other links in the chain, the pivots for the articulated chain being normally in line when the chain is under tension.

2. The chain of claim 1 wherein the extending portion of the driver link has a pivot to the next link, said last named pivot being remote with respect to the safety member.

3. The chain of claim 2 wherein the extending portion of the driver link rotates with the safety member, and the last named pivot rises with the rotative action.

4. The chain of claim 1 wherein the driver link is in the form of the letter L, the safety member being on one portion thereof and a pivot on the other portion, said last named pivot being connected to another link.

5. An articulated safety chain for a chain saw comprising driver links, cutting links, and interconnecting links, cutting teeth on the cutting links, safety members on the driver links, a first pivot connecting the driver and cutting links, each cutting link being in the general form of an L, its cutting tooth being located at the end of one portion of the L and the first pivot connecting it to the driver link being located at the end of the other portion of the L, the driver links each having a part in the general form of an L with a safety member at the end of one portion therof and a second pivot at the end of the other portion, the first pivot between each cutting link and driver link being adjacent the safety member and remote from the cutting tooth and the second pivot on the driver link, the safety member being in raised safety position under no-load and light load chain driving conditions and depressible to sawing position upon a heavy load condition of engagement with wood to be sawed, whereupon the said other portion of each driver link raises against the action of the tension of the chain.

6. An articulated chain for a chain saw, said chain comprising driver links, cutting links, and inter-connecting links, cutting teeth edges on the cutting links, safety members on other links, pivots connecting the links all of the pivots being in line during non-cutting intervals with the safety members in position to prevent cutting, and certain pivots moving during cutting intervals to position the safety members to allow cutting, a tab on each cutting link, the tabs extending outwards from the chain, a cutter gauge on each said other link having the safety member, said tabs and cutter gauges together limiting the depth of cut of the cutting edges.

7. The chain of claim 6 wherein each cutting edge is located between a tab and a cutter gauge.

* * * * *